US005858631A

United States Patent [19]

Quilitzsch et al.

[11] Patent Number: 5,858,631

[45] Date of Patent: Jan. 12, 1999

[54] PROCESSING COLOR PHOTOGRAPHIC MATERIALS

[75] Inventors: Udo Quilitzsch, Leichlingen; Herbert Mitzinger, Lindlar, both of Germany

[73] Assignee: Agfa Gevaert Aktiengesellschaft

[21] Appl. No.: 971,544

[22] Filed: Nov. 17, 1997

[30] Foreign Application Priority Data

Nov. 25, 1996 [DE] Germany ..... 196 48 760.9

[51] Int. Cl.[6] ..... G03C 7/42; G03C 7/44

[52] U.S. Cl. ..... 430/400; 430/393

[58] Field of Search ..... 430/393, 400

[56] References Cited

U.S. PATENT DOCUMENTS

| | | | |
|---|---|---|---|
| 3,634,088 | 1/1972 | Cooley . | |
| 3,700,450 | 10/1972 | Cooley . | |
| 3,879,203 | 4/1975 | Schranz et al. | 430/30 |
| 4,013,527 | 3/1977 | Idota et al. . | |
| 4,128,464 | 12/1978 | Idota . | |
| 4,204,930 | 5/1980 | Ono . | |
| 4,211,630 | 7/1980 | Blake et al. . | |
| 4,256,559 | 3/1981 | Ono . | |
| 5,298,371 | 3/1994 | Nakamura . | |
| 5,716,766 | 2/1998 | Kurokawa . | |

FOREIGN PATENT DOCUMENTS

| | | |
|---|---|---|
| 0 219 841 | 4/1987 | European Pat. Off. . |
| WO 90/08980 | 8/1990 | WIPO . |

*Primary Examiner*—Hoa Van Le
*Attorney, Agent, or Firm*—Connolly & Hutz

[57] ABSTRACT

The processing of exposed colour photographic materials by at least the steps of colour developing and bleach-fixing, with electrolytic desilvering of the spent bleach fixative solution, results in better utilisation of the processing chemicals and in a reduced amount of liquid to be disposed of, when bleach-fixing is effected in 2 steps, wherein a pH of $\geqq 7.4$ is set in the 1st step and a pH of $\leqq 7$ is set in the 2nd step, the bleach fixative from the 1st step is electrolytically desilvered and acid for maintaining the pH is fed to the 2nd step.

5 Claims, No Drawings

PROCESSING COLOR PHOTOGRAPHIC MATERIALS

This invention relates to the processing of exposed colour photographic materials, comprising at least the steps of colour developing and bleach-fixing, with regeneration of the processing baths and desilvering of the bleach fixative overflow.

The processing of colour photographic materials involves at least the steps of (a) colour developing, (b) bleaching and (c) fixing, wherein (b) and (c) can be combined to form bleach-fixing. In continuous operation, the processing baths are regenerated, i.e. the substances which are consumed by the processing operation are continuously added to them. An overflow is produced at the same time if the volume of liquid increases due to regeneration, or the processing bath is continuously transferred by pumping so that the substances arising during processing, which could interfere with processing, can be transferred out. The overflow or the pumped-over processing solution can be rejuvenated, since it still contains substances which are valuable for processing. Rejuvenation/recycling means that unwanted substances are removed and necessary chemicals which have been consumed are augmented by rejuvenator concentrates. The rejuvenate is fed to the overflow from the processing bath after the interfering substances have been removed, so that a regenerator of the appropriate type is again produced.

Rejuvenation and regeneration firstly ensure that better use is made of the processing chemicals and secondly ensure that there is a reduced amount of liquid to be disposed of.

Soluble silver salts become concentrated in the bleach fixative bath, and are transferred out by an overflow or by pumping them over. The overflow is usually desilvered by electrolysis in order to recover valuable silver. This is followed by the addition of rejuvenator concentrates, so that a bleach fixative regenerator is produced which can be re-used.

Since on the one hand the bleach fixative of the AP94/RA4 process has a pH of about 6, and on the other hand a satisfactory silver electrolysis can only be performed at pH values $\geqq 7.4$, it has hitherto been necessary to adjust the pH of the bleach fixative to $\geqq 7.4$ with alkali, and to acidify it again down to a pH of at least 6 after desilvering. The silver electrolysis could therefore only be carried out separately (off-line). However, a conjoint processing operation would be desirable in which the contents of the bleach fixative tank are desilvered directly (on-line).

The object of the present invention was to avoid altering the pH twice whilst nevertheless removing and recovering as large an amount of silver as possible from the bleach fixative, and to operate desilvering so that it is coupled to the processing procedure without the quality of the colour photographic products being impaired. Since, at a bleach-fixing time of 45 seconds, increased amounts of silver remain in the material when the pH is increased to 7.5, the object was also to effect on-line desilvering of the bleach fixative tank and nevertheless to arrive at amounts of residual silver in the material which are appropriate for its type.

This object is achieved by carrying out bleach-fixing in two steps, wherein a pH of $\geqq 7.4$ is set in the 1st step and a pH of $\leqq 7$ is set in the 2nd step, the bleach fixative from the 1st step is regenerated and is electrolytically desilvered, e.g. is continuously transferred by pumping between the processing tank and the electrolysis tank or is fed from the processing tank, via the electrolysis tank and at least one further tank (e.g. the regenerator tank), to the processing tank again, wherein the bleach fixative is desilvered by electrolysis in the electrolysis tank, and acid for maintaining the pH is fed to the 2nd step.

In a preferred embodiment of the invention, the processing procedure is combined with an advantageous regeneration process for the bleach fixative.

In the course of this procedure, the chemicals to be replenished are added in the form of at least two concentrated solutions of different compositions to the processing bath or to a rejuvenate obtained from the overflow or from bleach fixative which has been pumped over and desilvered.

The term "concentrated solutions" means that the processing chemicals are present in them in higher concentrations than is the case in the processing bath.

The preparation of a common regenerator solution is avoided by the direct metered addition of the concentrates; the concentrates are considerably more stable than the regeneration solution and result in lower costs.

The following concentrates, comprising the given characteristic chemicals, are preferably used in a bleach fixative for colour paper:

concentrate A: contains 350 to 700 g $(NH_4)_2S_2O_3$/l concentrate B: contains 300 to 610 g iron ammonium ethylenediamine-tetraacetic acid complex ($FeNH_4$ EDTA)/l The term "characteristic chemicals" means that the compounds are more usefully contained only in the concentrate cited in each case, and are not contained together in a concentrate, since the stability thereof would otherwise be jeopardised.

The use of the following further concentrates is advisable in order to carry out the method according to the invention with good results.

concentrate C: contains 500 to 1000 g ammonium hydrogen sulphite/l or comparable amounts of sodium or potassium sulphite, or any mixtures of these sulphites concentrate D: contains alkali (e.g. ammonia, soda or potash) in order to set the desired pH, unless the alkali dragged in from the developer is sufficient.

EXAMPLE

A colour negative paper comprising a support made of paper coated on both sides with polyethylene and—as seen from the support—a blue-sensitive silver halide emulsion layer containing a yellow coupler, an intermediate layer, a green-sensitive silver halide emulsion layer containing a magenta coupler, an intermediate layer, a red-sensitive silver halide emulsion layer containing a cyan coupler, a colloid layer containing a UV absorber, and a protective layer, with a dry layer thickness of the layer structure of 9 $\mu$m, a silver halide coating, calculated as $AgNO_3$, of 1.1 g/m$^2$, 99 mole % of the silver halides of which consist of AgCl, and gelatine as a binder for all the layers, is exposed image by image, is developed according to its type, and is bleach-fixed:

| Bleach fixative - 45 sec–35° C. | |
|---|---|
| 55 g | $(NH_4)_2S_2O_3$ |
| 18 g | $Na_2SO_3$ |
| 45 g | $FeNH_4$ EDTA |
| make up to 1 liter with water, adjust pH to | |
| step 1: | 7.5 |
| step 2: | 6.0. |
| Bleach-fixing is followed by washing or stabilising. | |

The bleach fixative (BX) is treated as follows for desilvering and regeneration:

Variant 1

Regeneration of step 1 with 215 ml BX regenerator/$m^2$ containing ammonium thiosulphate: 63 g/l sulphite (calculated as sodium sulphite): 40 g/l iron ammonium salt of ethylenediaminetetraacetic acid: 50 g/l pH 7.2±0.4

Electrolytic desilvering is followed by the addition of rejuvenator concentrates to each liter of BX overflow.

35 ml of part A containing 520 g $(NH_4)_2S_2O_3$/l 25 ml of part B containing 570 g $FeNH_4$ EDTA/l 10 ml of part C containing about 1000 g ammonium hydrogen sulphite/l.

Regeneration of step 2 (including correcting the level for evaporation losses) 5 ml/$m^2$ of 60% by weight acetic acid, so that the pH can be held within the range of tolerance from 5.7 to 7 in this BX step.

Variant 2

Regeneration of Step 1 (Metered Addition of Concentrate)

7 ml/$m^2$ of part A containing 520 g $(NH_4)_2S_2O_3$/l 160 g $K_2S_2O_3$/l 35 g potassium disulphite/l 5 g EDTA/l 11 g ammonia/l 5 ml/$m^2$ of part B containing 570 g $FeNH_4$ EDTA/l 2 ml/$m^2$ of part C containing 1000 g ammonium hydrogen sulphite/l The BX from the first step is continuously transferred by pumping between the BX tank of the processor and the electrolysis unit (1 to 10 l/minute) and is desilvered in the electrolysis unit.

Regeneration of step 2 (including correcting the level for evaporation losses)

4 ml/$m^2$ of 60% by weight acetic acid, so that the pH can be held within the range of tolerance from 5.7 to 7 in this BX step.

The sensitometric results are in accordance with the type and correspond to those which are obtained using a customary standard regeneration, wherein in a standard regeneration a single regeneration solution is prepared which contains all the chemicals to be regenerated in a concentration which corresponds to that of the processing bath or is slightly higher.

Concentrations such as those given for concentrates A to D cannot be achieved with a single regenerator solution, for reasons of stability.

We claim:

1. A method of processing exposed colour photographic materials by at least the steps of colour developing and bleach-fixing, characterised in that bleach-fixing is effected in 2 steps, wherein a pH of $\geqq 7.4$ is set in the 1st step and a pH of $\leqq 7$ is set in the 2nd step, the bleach fixative from the 1st step is regenerated and is electrolytically desilvered, and acid for maintaining the pH is fed to the 2nd step.

2. A method according to claim 1, characterised in that the bleach fixative from the 1st step is continuously transferred by pumping between the processing tank and the electrolysis tank for electrolytic desilverisation.

3. A method according to claim 1, characterised in that an overflow is produced in the 1st step of the bleach fixative, and is fed from the processing tank, via the electrolysis tank and at least one further tank, to the processing tank again, after the addition of rejuvenator concentrates.

4. A method according to claim 1, characterised in that regeneration of the 1st step is effected with at least two concentrated solutions of different compositions.

5. A method according to claim 4, characterised in that the at least two concentrated solutions contain the following characteristic chemicals:

concentrate A: 350 to 700 g $(NH_4)_2S_2O_3$/l concentrate B: 300 to 610 g $FeNH_4$ EDTA/l.

* * * * *